US005171169A

United States Patent [19]

Butcher et al.

[11] Patent Number: 5,171,169

[45] Date of Patent: Dec. 15, 1992

[54] DISCONNECTIBLE ELECTRICAL CONNECTION SYSTEM

[75] Inventors: Peter C. Butcher, Simi Valley; Roy Nimpoeno, Northridge, both of Calif.

[73] Assignee: Scosche Industries, Inc., Moorpark, Calif.

[21] Appl. No.: 792,444

[22] Filed: Nov. 21, 1991

[51] Int. Cl.[5] ..... H01R 11/26

[52] U.S. Cl. ..... 439/755; 403/339; 439/763; 439/798; 439/907

[58] Field of Search ..... 439/754–774, 439/777, 796, 797, 798, 907; 403/339, 340, 388

[56] References Cited

U.S. PATENT DOCUMENTS

| | | | |
|---|---|---|---|
| Re. 26,486 | 11/1968 | Haegert . | |
| 1,225,297 | 5/1917 | Willard | 439/760 |
| 1,507,936 | 9/1924 | Schmitt . | |
| 2,004,049 | 6/1935 | Hooever . | |
| 2,531,247 | 11/1950 | Batlle | 439/764 |
| 3,005,181 | 10/1961 | Ament | 439/773 |
| 3.407,383 | 10/1968 | Haegert . | |
| 3,656,094 | 4/1972 | Haegert . | |
| 3,795,891 | 5/1974 | Bailey | 439/797 |
| 3,821,694 | 6/1974 | Gottlieb . | |
| 4,012,104 | 3/1977 | Wening . | |
| 4,575,178 | 3/1986 | Coesfeld et al. . | |
| 4,643,511 | 2/1987 | Gawlik et al. . | |

FOREIGN PATENT DOCUMENTS

| | | | |
|---|---|---|---|
| 287239 | 3/1928 | United Kingdom | 403/339 |

*Primary Examiner*—Neil Abrams
*Attorney, Agent, or Firm*—William W. Haefliger

[57] ABSTRACT

A readily disconnectible electrical connection system comprising a connector body having structure for connection to an electrical power source, and a tongue projecting from the body, the tongue having a top surface and a threaded opening intersecting the top surface; and an adapter body having top and bottom surfaces, and multiple side surfaces; the adapter body having an internal recess intersecting one of the side surfaces, and also the bottom surface of the adapter, the recess sized to receive the tongue, and the tongue received in the recess; this adapter having a through-opening extending from the adapter top surface to the recess and being in registration with the threaded opening in the tongue to receive a fastener for threaded connection to the threaded opening; and the adapter having cable structure, and opening structure to receive electrical cable retention structure.

9 Claims, 3 Drawing Sheets

DISCONNECTIBLE ELECTRICAL CONNECTION SYSTEM

BACKGROUND OF THE INVENTION

This invention relates generally to improvements in disconnectible electrical connection systems, and more particularly concerns such a system of the type used to connect to vehicle battery terminals, and the like.

There is continuing need for simple, reliable multiple electrical connection equipment of the type used for connecting to battery terminals. Also, there is need for a rapidly disconnectible system which enables continued attachment of a connector element to a battery post, other elements of the connector system being easily disconnectible from the connector element attached to the post. No prior system, of which I am aware, provides all of the unusual advantages in construction, modes of operation and results as are now afforded by the present system.

SUMMARY OF THE INVENTION

It is a major object of the invention to provide an improved disconnectible electrical connection system meeting the above needs. Basically, the system comprises, in combination:

a) a connector body having means for connection to an electrical power source, and a tongue projecting from the body, the tongue having a top surface and a threaded opening intersecting the top surface, b) and an adapter body having top and bottom surfaces, and multiple side surfaces, c) the adapter body having an internal recess intersecting one of the side surfaces, and also the bottom surface of the adapter, the recess sized to receive the tongue, and the tongue received in the recess, d) the adapter having a through-opening extending from the adapter top surface to the recess and being in registration with the threaded opening in the tongue to receive a fastener for threaded connection to the threaded opening, e) and the adapter having cable means, and opening means to receive electrical cable retention means.

As will be seen, the cable opening means comprises at least one cable opening intersecting a side surface of the adapter body, and multiple set screw openings may be provided in the top of the body for reception of set screw to clamp the received cable. In addition, the connector body may typically define a clamp sized to fit over a standard battery post, the clamp defining a post-receiving opening which extends orthogonally relative to the tongue, which projects from the connector body. Accordingly, when the battery post is received vertically into the clamp, the tongue projects sidewardly, enabling ease of disconnection of the tongue from the adapter and, in particular, via the recess that receives the tongue. In this regard, fastener received downwardly into the adapter body to clamp the tongue in the recess may be easily disconnected from the tongue allowing quick separation of the adapter from the tongue.

It is another object of the invention to provide the means for connection to an electrical power source in the form of a loop having an opening which extends orthogonally relative to the tongue, and including a fastener having an upper portion rotatable in the loop, and a threaded portion extending below the loop.

A further object of the invention is to provide the means for connection to an electrical power source in the form of a threaded opening in a projection on the adapter, for reception of a set screw in that opening to clamp to a cable sidewardly received into the projection.

Yet another object is to provide the adapter with oppositely angled, beveled surfaces defining planes extending generally toward the connector body, such planes adapted to receive the fingers of a use to pull or retract the adapter away from the connector body during rapid disconnection of these elements.

These and other objects and advantages of the invention, as well as the details of an illustrative embodiment, will be more fully understood from the following specification and drawings, in which:

DRAWING DESCRIPTION

DETAILED DESCRIPTION

Figure 1:
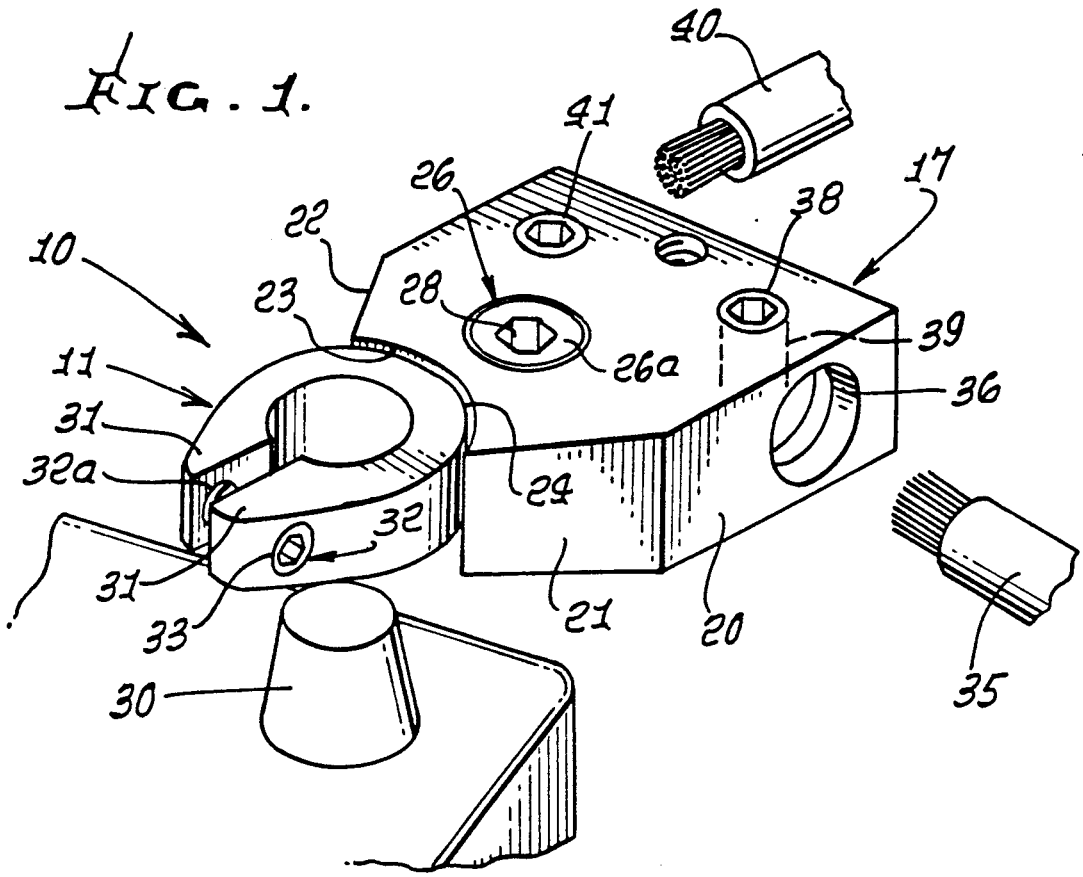
FIG. 1 is a perspective view showing an assembled body and adapter in relation to a battery post and a cable or cables.
Figure 2:
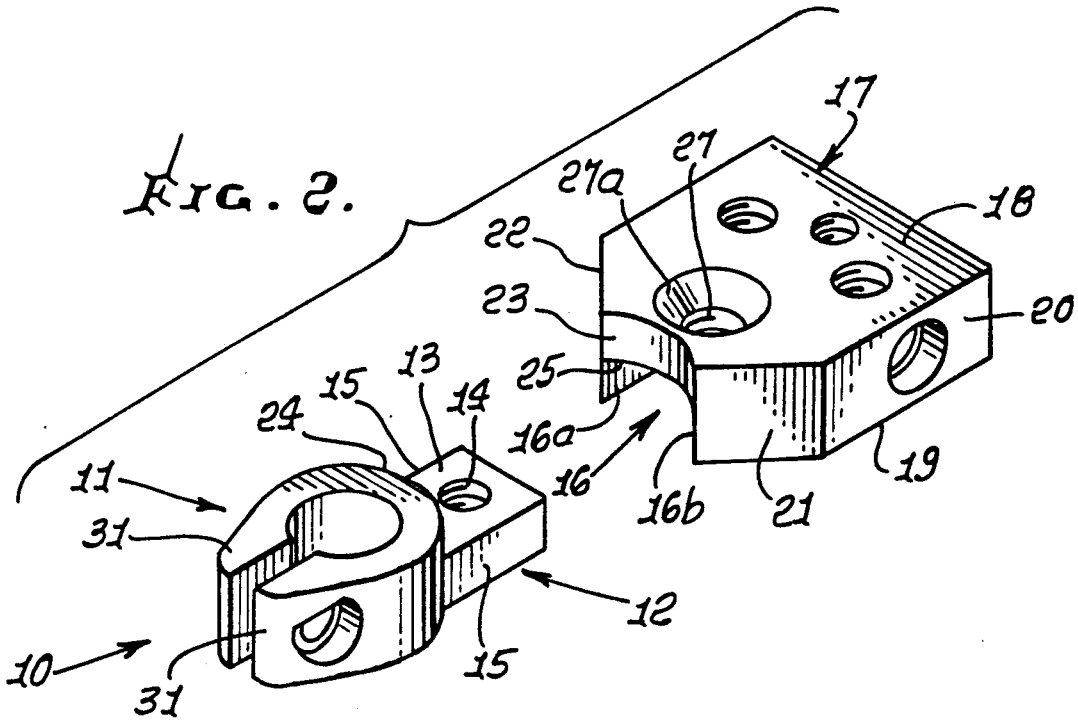
FIG. 2 is a view like FIG. 1 showing the connector body and adapter in separated condition.

Referring first to FIGS. 1 and 2, a connector body 10 has means for connection to an electrical power source, such means generally indicated at 11. Also, the body has a tongue 12 projecting longitudinally, the tongue having a top surface 13 and a threaded opening 14 extending downwardly into the tongue body from its top surface 13. The tongue has parallel and vertical opposite sides 15 adapted to closely fit into a corresponding internal recess 16 in an adapter body 17. The latter has flat top and bottom surfaces 18 and 19, and multiple side surfaces, three of which are shown at 20, 21, 22, and also 23. The recess 16 intersects the side surface 23 and the bottom surface 19, whereby the tongue may sit rightwardly into the recess, or upwardly into the recess, or both, for ease and rapidity of connection and disconnection.

The side surface 23 of the adapter body is concavely curved to fit against the convexly curved surface 24 of the connector body, and act as a stop shoulder limiting rightward reception of the tongue into the recess. Also, an internal surface 25 of the recess faces downwardly and limits upward insertion of the tongue top surface upwardly into the recess, whereby precise positioning of the tongue in the recess is easily and rapidly obtained. Recess side walls **16*a* and 16*b* closely fit tongue side walls 15**.

FIG. 1 shows the head **26*a* of a threaded fastener 26 received downwardly into a downward opening 27 in the adapter, whereby the fastener threaded shank is received into the threading opening 14 of the tongue to positively attach the adapter to the tongue or vice versa. Note that the opening 27 has a conical mouth 27*a* to receive the conical underside head of the fastener. A hexagonal opening 28 in the fastener permits rapid rotation of same by a hex tool. This allows rapid disconnection of the adapter block 17** from the battery post.

The connector body 11 has means for connection to an electrical power source, such means taking the form, in FIGS. 1 and 2, of a C-shaped clamp sized to fit over a standard battery post 30. Accordingly, it is frustoconically tapered, internally, to fit the post surface.

Note that the clamp has like, opposed arms 31 which may be tightened toward one another to positively engage the clamp to the battery post, as by means of a fastener 32 extending between the arms. The fastener may be threaded at shank 32*a* to engage one of the arms, and may have a head 33 seated by the other arm. Once this connection is made to the battery post, it need not be disturbed, since the electrical disconnection is then made by separating the tongue 13 from the recess 16, as described above. A cable 35 is insertible into a side opening 36 in the block or adapter body 17 and fastened in that opening by a set screw 38 received downwardly in a threaded opening 39 in the adapter. Another cable 40 may be similarly connected to the adapter 17 and retained by a set screw 41, as shown. Multiple cable terminals and connections are thereby provided.

Note that the side surfaces 21 and 22 of the adapter extend in planes angled convergently toward the connector 10, to provide finger holds for pulling the adapter away from the connector, as may be required or desired, for rapid disconnection of the tongue from the recess, either vertically or horizontally, or both.

Figure 3:
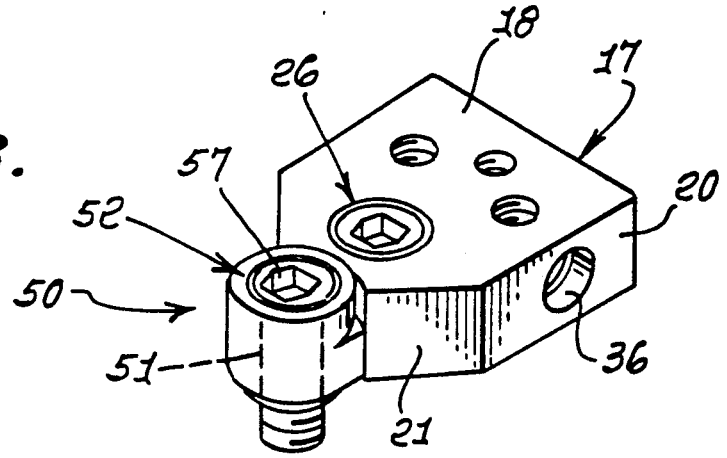
FIG. 3 is a view like FIG. 1 showing another form of the connection system.
Figure 4:
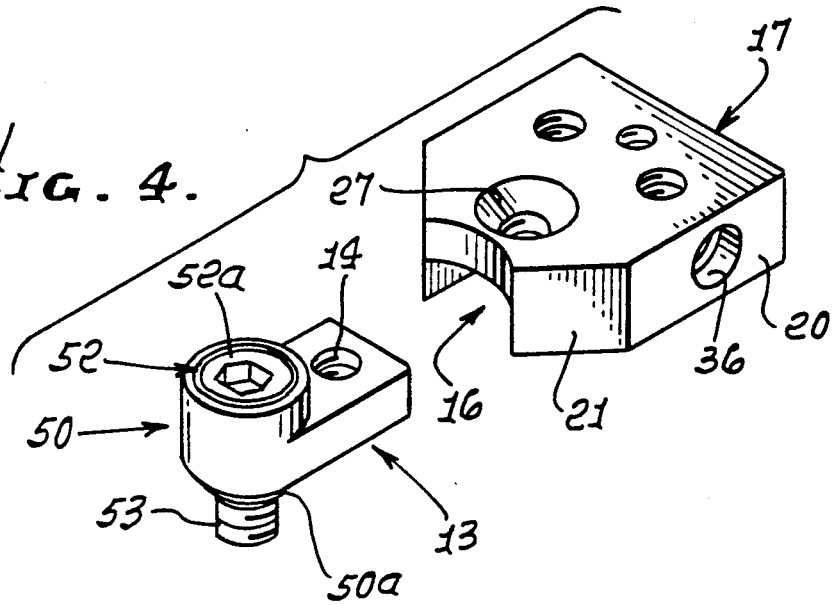
FIG. 4 is a view like FIG. 3 but showing the elements in separate condition.
Figure 5:
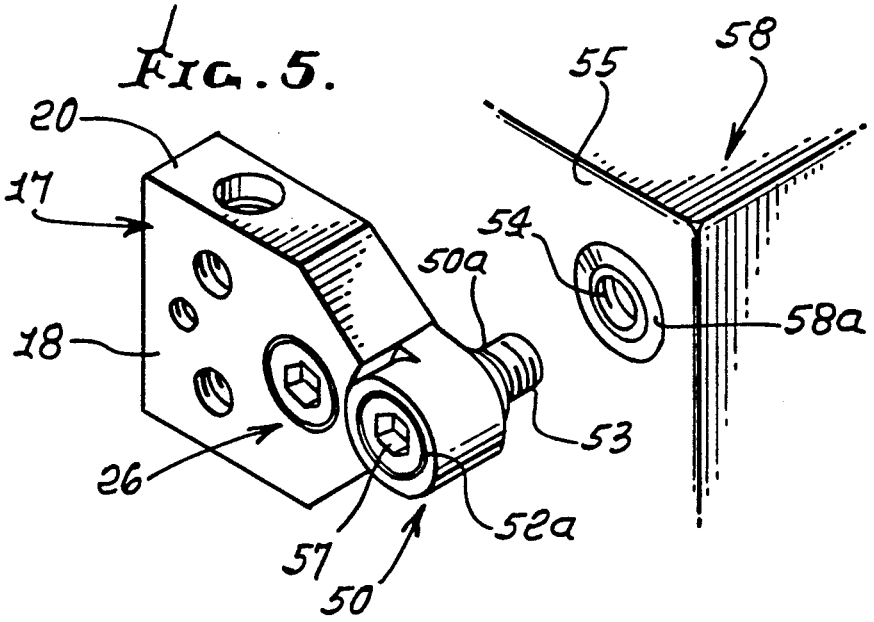
FIG. 5 shows the FIG. 3 assembly position for attachment to a battery terminal.

The elements of the invention shown in the modified system of FIGS. 3–5 are the same as in FIGS. 1 and 2 except for the elimination of the clamp, as described and the substitution of a loop 50 defining a vertical opening 51 which extends orthogonally vertically relative to the horizontally extending tongue 13. A fastener 52 has a head 52*a* rotatable in the loop above a beveled shoulder, to thereby rotate a threaded lower portion 53 of the fastener extending below the loop.

FIG. 5 shows the threaded portion 53, as attached, for reception in a sidewardly facing threaded opening 54 in the side 55 of a battery case, as provided on certain vehicles. This affords a quick and reliable connection to the battery terminal; and once installed, the disconnection may be made at the tongue and recess, as by separation of the latter in the manner described above. A hex opening 57 is formed in the head 52*a* of the fastener for reception of a hex tool to rotate the fastener. Loop end shoulder 50*a* engages annulus 58*a* on the side of the battery 58.

Figure 6:
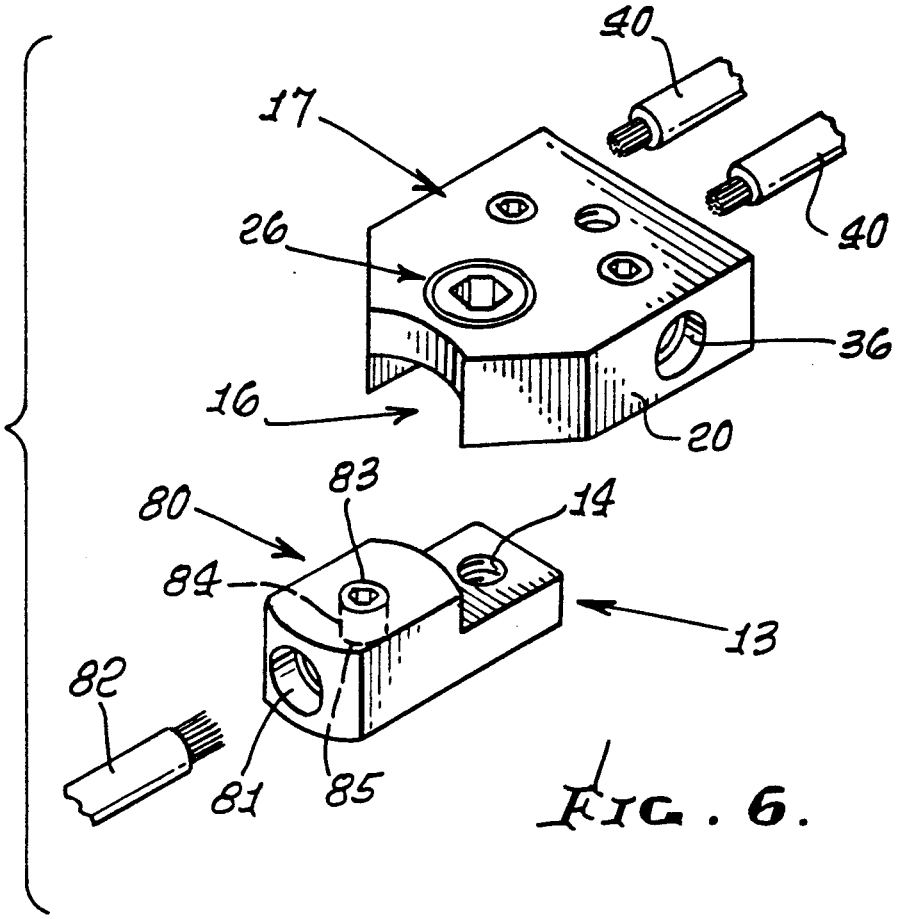
FIG. 6 is a view like FIG. 1 showing yet another form of the invention.
Figure 7:
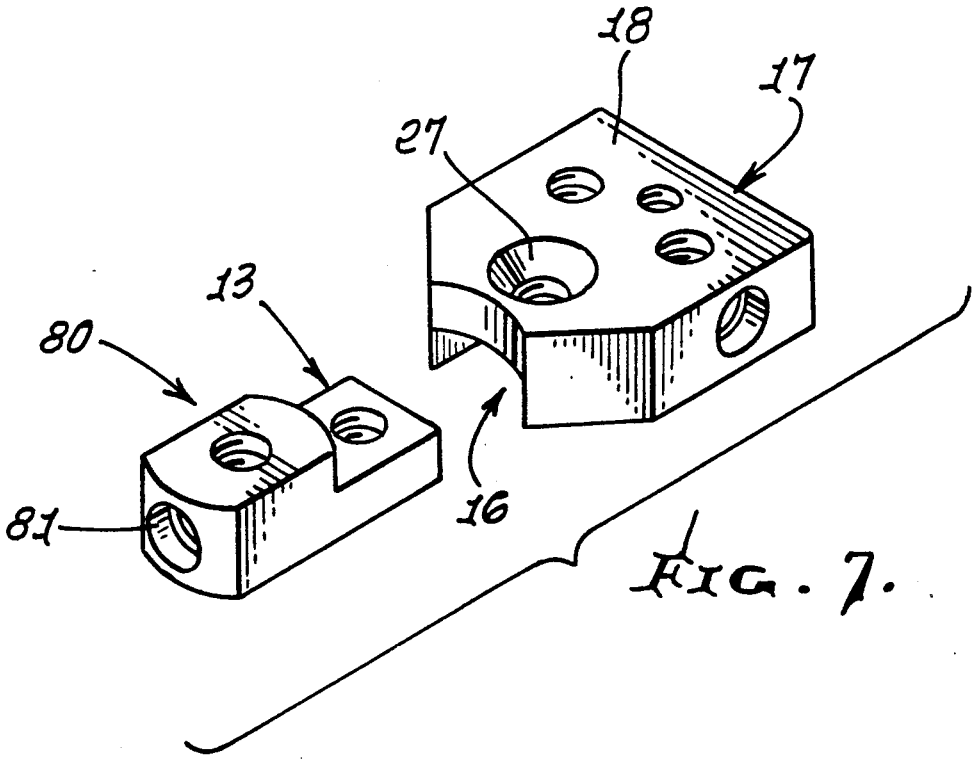
FIG. 7 is a view like FIG. 6 but showing the elements in separated condition.

The form of the invention shown in FIGS. 6 and 7 is also the same as in FIG. 1 with the exception of a variation in the connector body. As shown, the body 80 is elongated in the direction of the tongue projecting from the body. An end opening 81 in the body is adapted to receive a power supply cable 82 for retention in the body. A set screw 83 has a threaded shank 84 threaded into an opening in the body, and the lower end 85 of the set screw is engageable with the side of the cable to retain it in position as the set screw is tightened. The cable 87 is received in end opening 88 in body 80.

The advantages in construction, modes of operation and results, as described herein, are found in each of the three forms of the invention and provide a reliable, easily installed and easily disconnected electrical connection assembly. Adapter 17 is universal, i.e, attachable to any of the connector bodies 11, 50 and 80, as referred to.

I claim:

1. In a readily disconnectible electrical connection, system, the combination comprising a) a connector body having means for connection to an electrical power source, and a tongue projecting from the body, the tongue having a top surface and a threaded opening intersecting said top surface, b) and an adapter body having top and bottom surfaces, and multiple side surfaces, c) said adapter body having an internal recess intersecting one of said side surfaces, and also the bottom surface of the adapter, said recess sized to receive said tongue, and said tongue received in said recess, d) the adapter body having a through-opening extending from the adapter body top surface to said recess and being in registration with said threaded opening in the tongue to receive a fastener for threaded connection to said threaded opening, e) and said adapter body having cable opening means to receive electrical cable retention means, f) said connector body having a side surface above said tongue top surfaces, said side surface being convex toward one of said adapter body side surfaces which is concave toward said convex side surface to provide a stop for aligning said through opening and said threaded opening, and two other side surfaces of the adapter body tapering toward said convex side surface to be finger engageable for positioning the adapter body and recess relative to said connector body and tongue.

2. The combination of claim 1 wherein said cable opening means comprises at least one cable opening intersecting a side surface of the adapter.

3. The combination of claim 1 wherein said cable opening means comprises multiple cable openings to receive multiple cables, and which intersect multiple of said side surfaces, respectively.

4. The combination of claim 2 wherein said cable retention opening means intersects the top surface of the adapter.

5. The combination of claim 3 wherein said cable retention opening means comprises multiple cable retention openings intersecting said top surface of the adapter and also intersecting said multiple cable openings, respectively, for reception of fasteners to grip cables in said cable openings.

6. The combination of claim 1 wherein said connector body defines a C-shaped clamp sized to fit over a standard battery post.

7. The combination of claim 6 wherein said clamp defines a post-receiving opening which extends orthogonally relative to said tongue.

8. The combination of claim 1 wherein said connector body has a top surface and a side surface, and the body defines a cable-receiving opening intersecting said side surface, there being a cable-retention opening means in the connector body which intersects said top surface thereof and said cable-receiving opening internally of the connector body, whereby a cable retention fastener may be received in said cable-retention opening means to clamp to a cable in said cable-receiving opening.

9. The combination of claim 1 wherein said connector body includes a loop defining an opening which extends orthogonally relative to said tongue, and including a fastener having an upper portion rotatable in said loop, and a threaded portion extending below said loop.

* * * * *